US006101899A

United States Patent [19]

Nikolic

[11] Patent Number: 6,101,899

[45] Date of Patent: Aug. 15, 2000

[54] ELECTRIC CORKSCREW

[76] Inventor: Dusan Nikolic, 66 Cameron Avenue, Willowdale, Ontario, Canada, M2N 1E1

[21] Appl. No.: 09/093,352

[22] Filed: Jun. 9, 1998

[51] Int. Cl.[7] ..... B67B 7/00

[52] U.S. Cl. ..... 81/3.2; 81/3.35

[58] Field of Search ..... 81/3.2, 3.35, 3.45, 81/3.29

[56] References Cited

U.S. PATENT DOCUMENTS

| | | | |
|---|---|---|---|
| 241,929 | 5/1881 | Clark | 81/3.2 |
| 4,393,733 | 7/1983 | Desnoulez et al. | 81/3.38 A |
| 4,637,283 | 1/1987 | Bertram et al. | 81/3.2 |
| 5,351,579 | 10/1994 | Metz et al. | 81/3.2 |
| 5,372,054 | 12/1994 | Federighi, Sr. | 81/309 |
| 5,503,047 | 4/1996 | Brockington | 81/3.2 |
| 5,724,869 | 3/1998 | May | 81/3.2 |

*Primary Examiner*—David A. Scherbel
*Assistant Examiner*—David B. Thomas

[57] ABSTRACT

An electrically powered corkscrew has an inclined handle of high ergonomic character to enable convenient and effective use when standing or seated, while ensuring a corkscrew of compact arrangement. The corkscrew has a de-briding cutter concealed in the butt of the handle for removing the usual foil seal from the cork. The cork extracting mechanism includes a dual purpose cork-stabilizing arrangement, including a pair of compression springs and guide posts to assist in countering rotation of the cork, and in assisting reverse operation of the corkscrew auger when discarding the cork.

18 Claims, 7 Drawing Sheets

ELECTRIC CORKSCREW

FIELD OF THE INVENTION

This invention is directed to a corkscrew for removing corks from wine bottles, and in particular to an electrically powered corkscrew.

BACKGROUND OF THE INVENTION

The existence of proposed corkscrew electrical appliances is evidenced by the following United States Patents:

U.S. Pat. No. 4,955,261, Chiang, September 1990;

U.S. Pat. No. 5,079,975, Spencer, January 1992; and

U.S. Pat. No. 5,095,778, Bocsi et al., March 1992.

However, the proposed corkscrews illustrated in these patents suffer from a number of defects that militate against the likelihood of their achieving commercial success.

In the case of Chiang ('261) the battery case-cum-handle is of a most awkward shape and size, and is quite unsuited for being readily secured and gripped, while the right angled projection of the auger tube from the battery case/handle makes the device ergonomically unsuitable in that it requires a user to stand over the bottle being opened, with the "handle" extending substantially horizontally in an inconvenient orientation.

Spencer ('975) and Bocsi et al. ('778) each provides a handle portion comprising a battery compartment oriented in axially aligned relation with the operative portion of the respective device. These arrangements, in addition to the resulting undue length of the devices, also are ergonomically unsuitable, while also requiring a user to grip the handle sufficiently tightly to provide the requisite torque necessary to off-set the reaction torque generated by the action of the bottle opening auger in penetrating and drawing the cork. Furthermore, a user has to position their operative hand well above the bottle, in an unusual posture.

SUMMARY OF THE INVENTION

The present invention provides a corkscrew electrical appliance, the inclined handle of which facilitates the ready application of stabilizing torque force to the device, when in operation. Portability also is enhanced.

The subject device is provided with an ergonomically suitable handle that minimizes the height of the device, while facilitating use of the device, even with the user in a seated position, if so desired. Use of the device in a standing posture also is very convenient.

Furthermore, the device includes provision for the severance of the usual foil cap from the crown of a wine bottle.

The present invention provides an electrically powered corkscrew having a body portion and a handle extending laterally therefrom, the body portion including an outer barrel to receive the neck of a bottle in entered relation therein; rotatable cork auger means substantially coaxial with the barrel, and cork restraint means located within the barrel, in use to limit rotation of a cork relative to the barrel, under the influence of the rotation 25 of the auger means.

The corkscrew includes bottle stop means within the barrel, to limit the penetration of a bottle neck within the barrel.

The aforesaid bottle stop means is axially movable a predetermined distance within the barrel, to permit entry of the bottle neck as the auger makes its initial penetration of the coil, prior to the commencement of cork extraction.

The cork restraint means of the corkscrew includes at least one axially extending rib, to engage an outer surface portion of the cork, to substantially preclude rotation of the cork within the barrel.

The cork restraint means includes an inner barrel located within the outer barrel and movable axially therein and including a tongue and groove connection between the inner and the outer barrel, to permit relative axial displacement between the two barrels while substantially precluding relative rotation therebetween.

The cork restraint means includes compression spring means extending axially relative to the barrel, in off-centred relation therewith, and connecting in rotation-inhibiting relation with the inner barrel.

The off-centred spring means may comprise a pair of diametrically spaced compression springs, each having a guide rod extending therethrough, the guide rods projecting within axially extending recesses of the inner barrel, to preclude rotation of the inner barrel relative to the outer barrel.

The compression springs, in addition to resiliently loading the corkscrew during the extraction mode, serve also as an ejector, to initially assist the auger, when rotating in reverse, to eject the extracted cork.

The cork restraint means preferably includes two of the axially extending ribs in mutual, diametrically opposed relation, being of a shallow depth to permit displacement of a cork therealong in axially guided, rotationally restrained relation.

The aforesaid bottle stop means preferably comprises the axial outer end face of the inner barrel, capable of limited axial displacement within the outer barrel. The inward travel of the inner barrel during the cork extraction mode is resisted and cushioned by the compression springs.

The laterally extending handle of the corkscrew is inclined from the body portion at an included angle in the range 60 to 75 degrees.

The preferred angle of the handle is about 70 degrees, to optimize the ergonomic benefits. This acute angle also facilitates carrying the corkscrew, the acute angle of the handle militating against slippage from the hand.

The seal cutter means is preferably recessed in the butt of the handle portion, to provide access for the crown of a foil-sealed bottle therein, the aforesaid seal cutter preferably comprising a pair of mutually diametrically opposed, inwardly extending cutter blades. The seal cutter means may be electrically powered.

The corkscrew is electrically powered, having electric power means located within the handle, which may include the electric motor.

The electric power means preferably includes battery means to power the electric motor.

The battery means are preferably rechargeable batteries.

The device may be combined with separate battery charging means, the charging means having a body portion to receive the corkscrew in supported, secured battery-charging relation.

In a preferred embodiment the body portion of the charging means has a pair of electrical spade contacts to suspend the combination charger/corkscrew in assembled charging relation from an electrical outlet, as a wall-mounted corkscrew holder.

In another embodiment, the charging means is removable from the body portion for replacement or recharging in a separate charging unit.

BRIEF DESCRIPTION OF THE DRAWINGS

Certain embodiments of the invention are described by way of illustration, without limitation of the invention thereto, reference being made to the accompanying drawings, wherein.

DETAILED DESCRIPTION OF THE DRAWINGS

Figure 1:
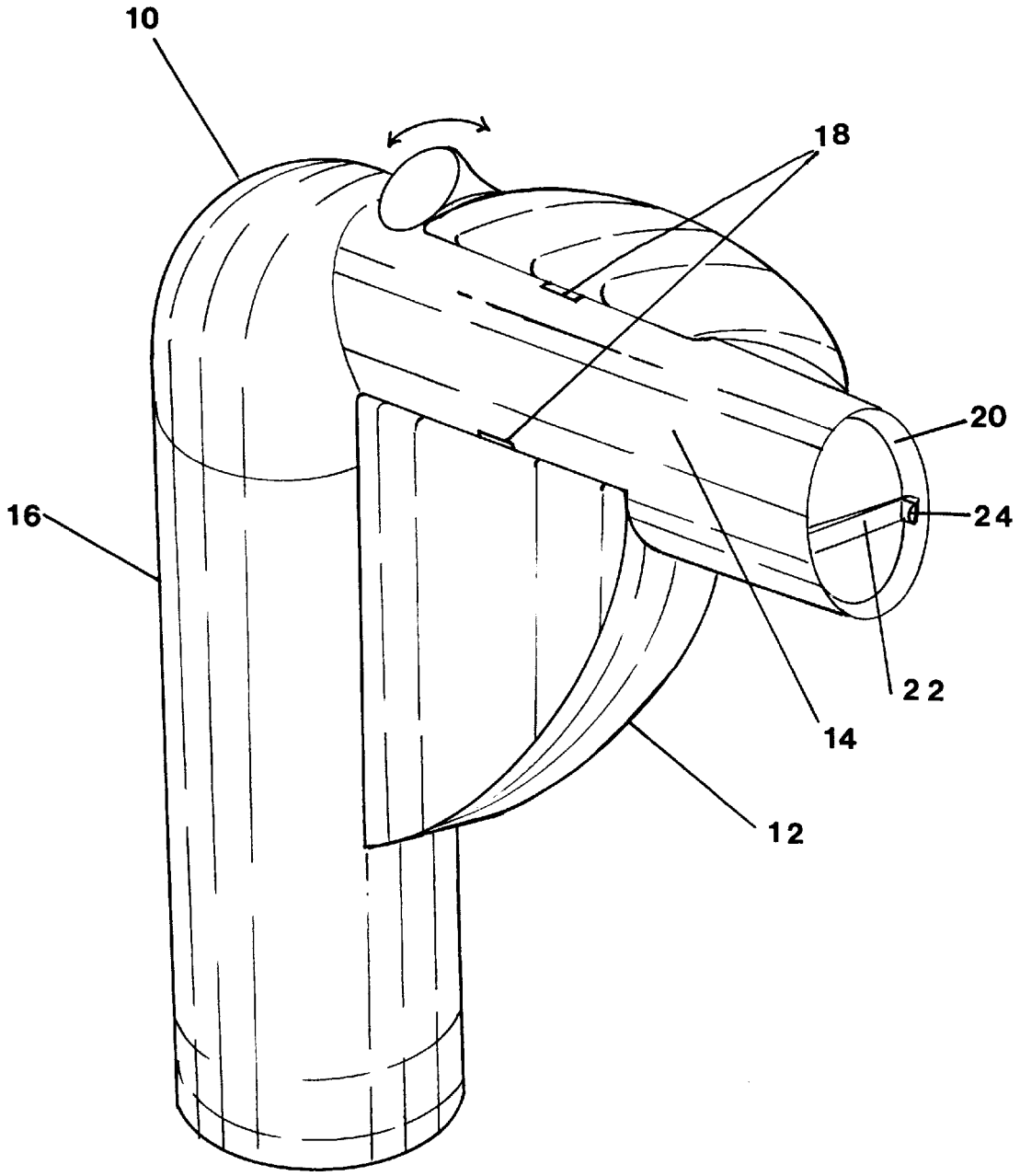
FIG. 1 is a front perspective view of a corkscrew in accordance with the present invention, in assembled relation with a battery charging means.

Referring to FIG. 1 corkscrew 10 embodiment according to the present invention is shown in mounted relation with the battery charging means 12.

The corkscrew 10 has a handle portion 14 and body portion 16. The handle portion 14 is secured in charge-receiving relation to the battery charging 12 by way of a pair of resilient charge transfer contacts 18.

The recessed butt portion 20 of handle portion 14 contains a seal cutting means comprising rotary de-briding cutter 22, having a pair of opposed resiliently mounted cutter blades 24, one of which is shown.

Figure 2:
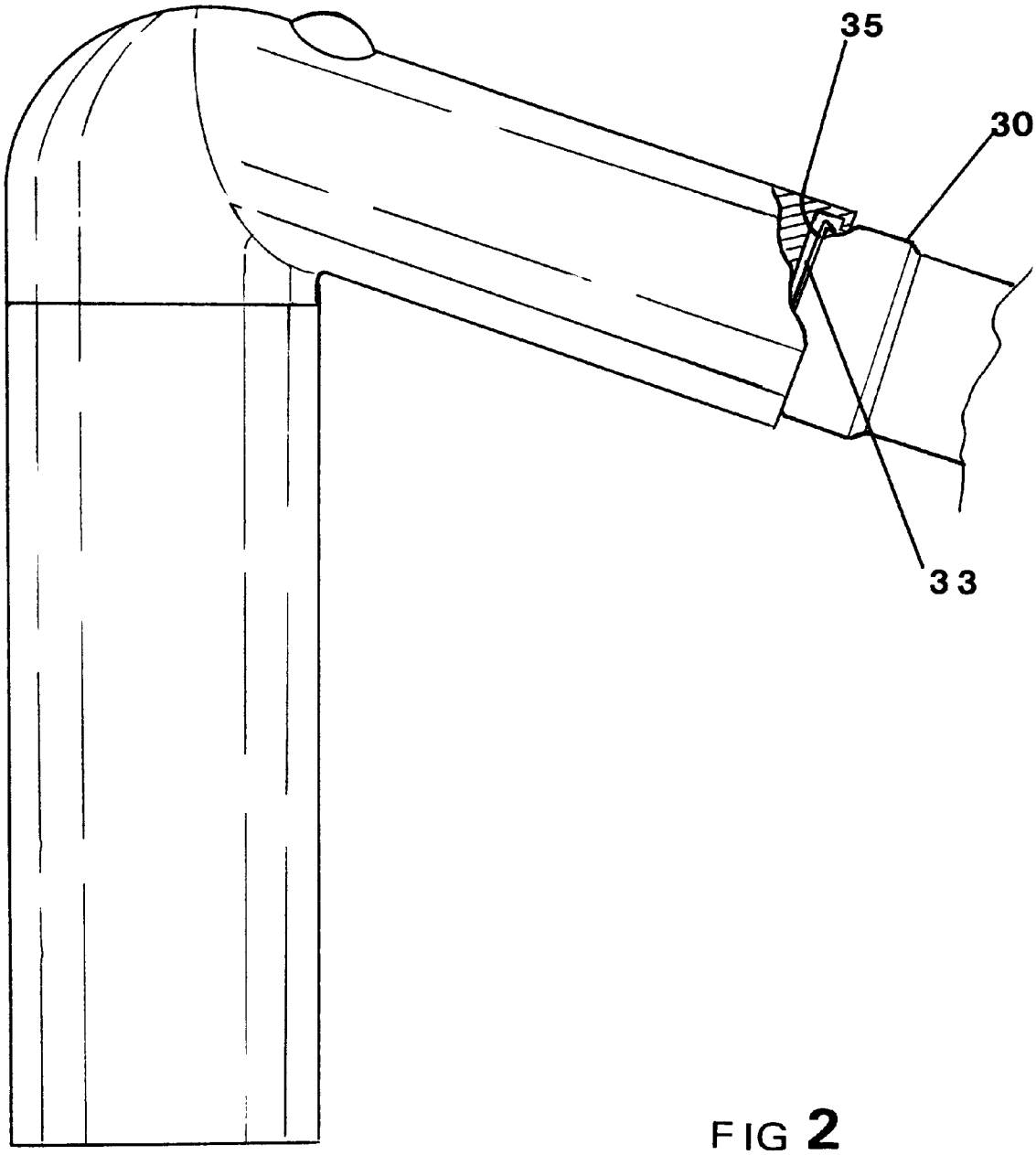
FIG. 2 is a side elevation of the subject corkscrew in relation to a wine bottle, for the severance of the foil crown protector.

FIG. 2 shows a neck portion 30 of a bottle 32 having the crown 33 thereof de-brided (i.e. cutting off the protective foil layer 35), within the butt recess 20.

Figure 3:
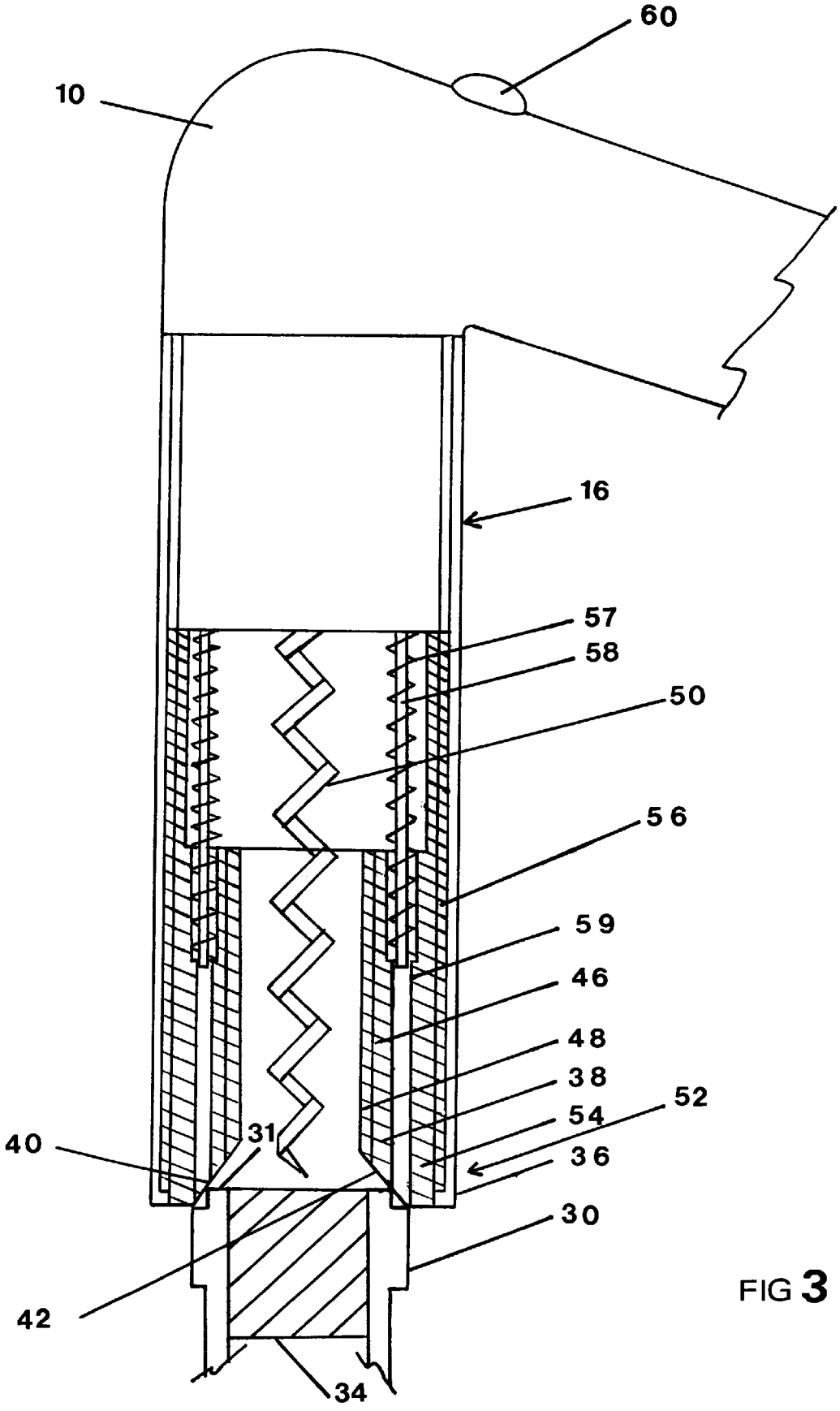
FIG. 3 is a side view, in partial diametrical section of the barrel portion of the subject device, having the crown portion of a corked bottle inserted, preparatory to removal of the cork thereof.

FIG. 3 shows the body portion 16 of corkscrew 10 in partial diametrical section, with a neck portion 30 of a bottle (not shown) presented to the body portion 16 in aligned relation therewith, for removal of the cork 34.

An outer barrel portion 36 of body portion 16 contains inner barrel portion 38, which has a conical entry portion 40 by which the crown portion 31 of bottle neck portion 30 is centred in the corkscrew 10, for passage into the outer barrel portion 36.

The inner barrel portion 38 is further tapered at 42 to provide a conical guidance surface by which the cork 34 enters the bore 46 of the inner barrel portion 38.

The bore 46 contains a pair of narrow, shallow, inwardly projecting ribs 48 in mutual, diametrically opposed relation, to engage the cylindrical outer surface of cork 34.

An auger 50 of usual spiral form is rotatably mounted on the main axis of corkscrew 10. In operation, as the cork 34 is engaged by auger 50, on upward entry of the bottle crown into the barrel 36, and cork 34 is drawn from the bottle neck portion 30, it is secured against rotation by the ribs 48, to enable the auger 50 to continue its upward withdrawal of cork 34, as the cork 34 is drawn upwardly along the rotating ramp surfaces that constitute the auger 50.

Figure 4:
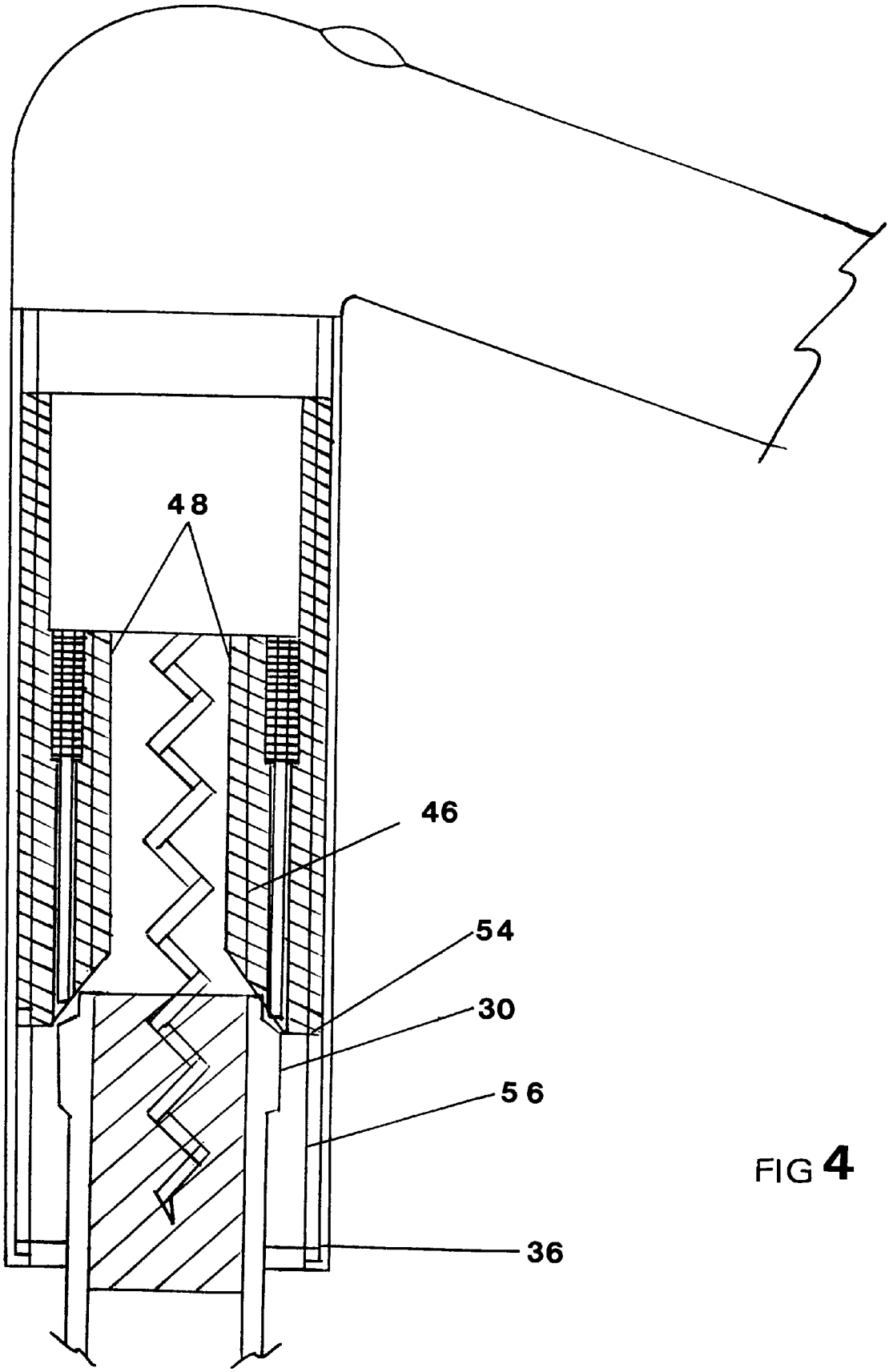
FIG. 4 is a view similar to FIG. 3, showing the cork auger partially inserted and the bottle neck entered within the device.

A tongue and groove connection 52 between the radially outer portion of inner barrel portion 38, and the radially inner portion of outer barrel portion 36 comprises a pair of diametrically opposed tongue portions 54 and corresponding grooves 56 (see also FIG. 4).

This tongue and groove connection 52 permits axial sliding of the inner barrel portion 38, while precluding any relative rotational displacement therebetween.

This serves to stabilize the cork 34 against rotation, relative to barrel portions 38 and 36, so that rotation of the auger 50 results in axial displacement of the cork 34 along the auger in the respective axial direction corresponding to the direction of rotation of the auger 50.

A pair of compression springs 57 mounted on guide rods 58 project axially in fixed relation within the outer barrel portion 36. Passages 59 extending axially within inner barrel portion 38 permit axial upward displacement of barrel portion 38, in compressing relation with the springs 57.

In operation, de-briding of the foil protective cover 35 from the bottle crown 33 is first carried out by applying the recessed but portion 20 of handle portion 14 over the bottle crown 33, (FIG. 2) and actuating the control switch 60, to sever the foil layer 35 from over the cork 34. The switch 60 is then released to its intermediate "off" position.

Then, applying the barrel 36 in axially aligned relation to the bottle neck portion 30 enters the crown portion 31 in centred relation (FIG. 3), while the inner barrel portion 38 is displaced inwardly, under gentle hand pressure until the tip of the auger 50 penetrates the cork 34.

Actuation of switch 60 in the "forward" sense produces rotation of auger 50, to further penetrate the cork, drawing the cork 34, together with the bottle neck portion 30 further within the outer barrel portion 36.

The inner barrel portion 38 is pushed inwardly by the bottle crown 33, against the compression springs 57, until barrel portion 38 reaches the end of its upward travel (see FIG. 4).

Up to this point there has been only a light load applied to the auger 50. At this juncture, the auger 50 has penetrated deeply into the cork 34, and with the cessation of inward axial movement of the bottle neck portion 30, against the outer end face of inner barrel portion 38, pulling of the cork 34 therefrom commences.

The cork 34 is stabilized against rotation by the gripping action of the bottle neck portion 30, so that it travels axially upwards, (FIG. 5) propelled along the auger 50 by the rotation of the latter.

As the cork 34 withdraws from the bottle neck portion 30 it enters the bore 46 of inner barrel portion 38 and forces itself in surface-conforming relation about the ribs 48.

Figure 5:
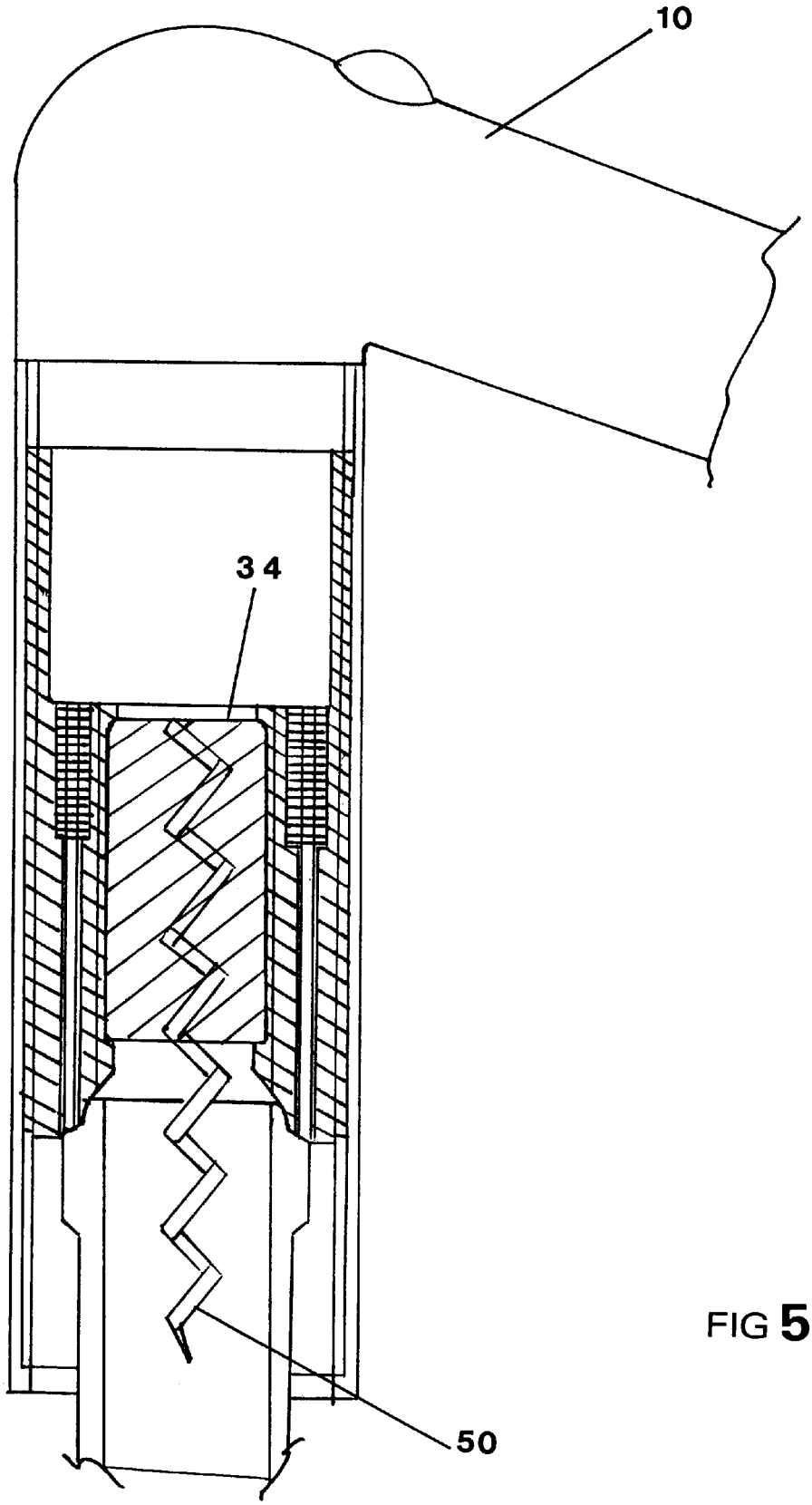
FIG. 5 is a view similar to FIGS. 3 and 4, showing the cork withdrawn from the bottle.

As the cork 34 leaves the restraints of the bottle, the ribs 48 preclude any rotation of cork 34, so that the auger 50 can complete the axial withdrawal of cork 34 into the inner barrel portion 38 (FIG. 5). The thus uncorked bottle is then free to be removed, for use of its contents.

Reverse positioning of the switch 60 then drives the auger 50 in the reverse direction, to produce downward travel of the cork 34 and inner barrel portion 38, aided by expansion of the springs 57, until the inner barrel portion 38 reaches its outer limit.

The cork 34 the continues to travel down the auger 50 until it is finally clear of the corkscrew 10.

Figure 6:
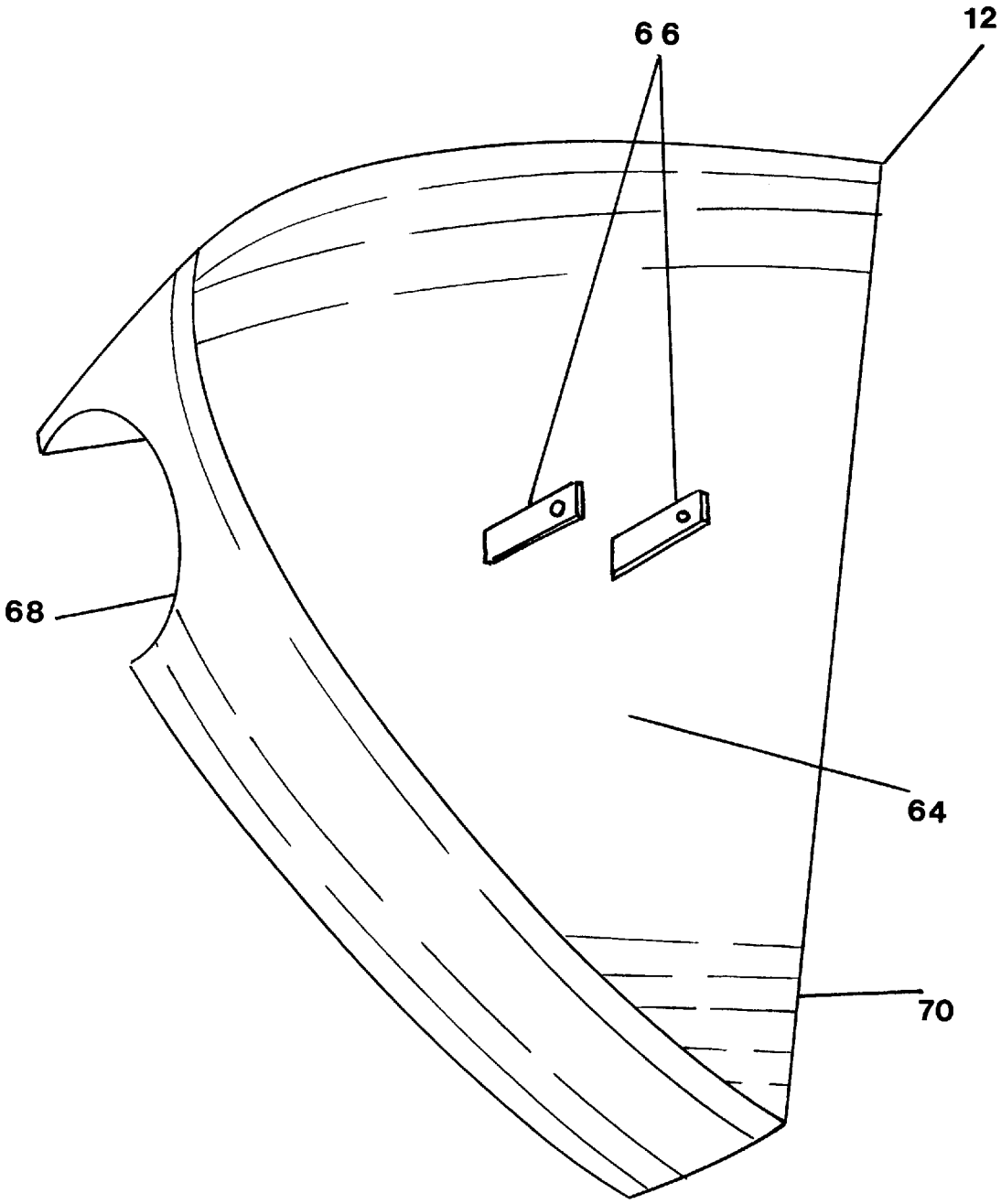
FIG. 6 is a rear perspective view of the battery charging device by which the subject corkscrew is mounted to an electrical outlet, in suspended relation therefrom.

Referring to FIG. 6, the battery charging means 12 has a planar rear face 64 from which extends a pair of electrical spade contacts 66, by which the combination of charger 12 and corkscrew 10 may be suspended from a wall-mounted standard electrical outlet (not shown).

Figure 7:
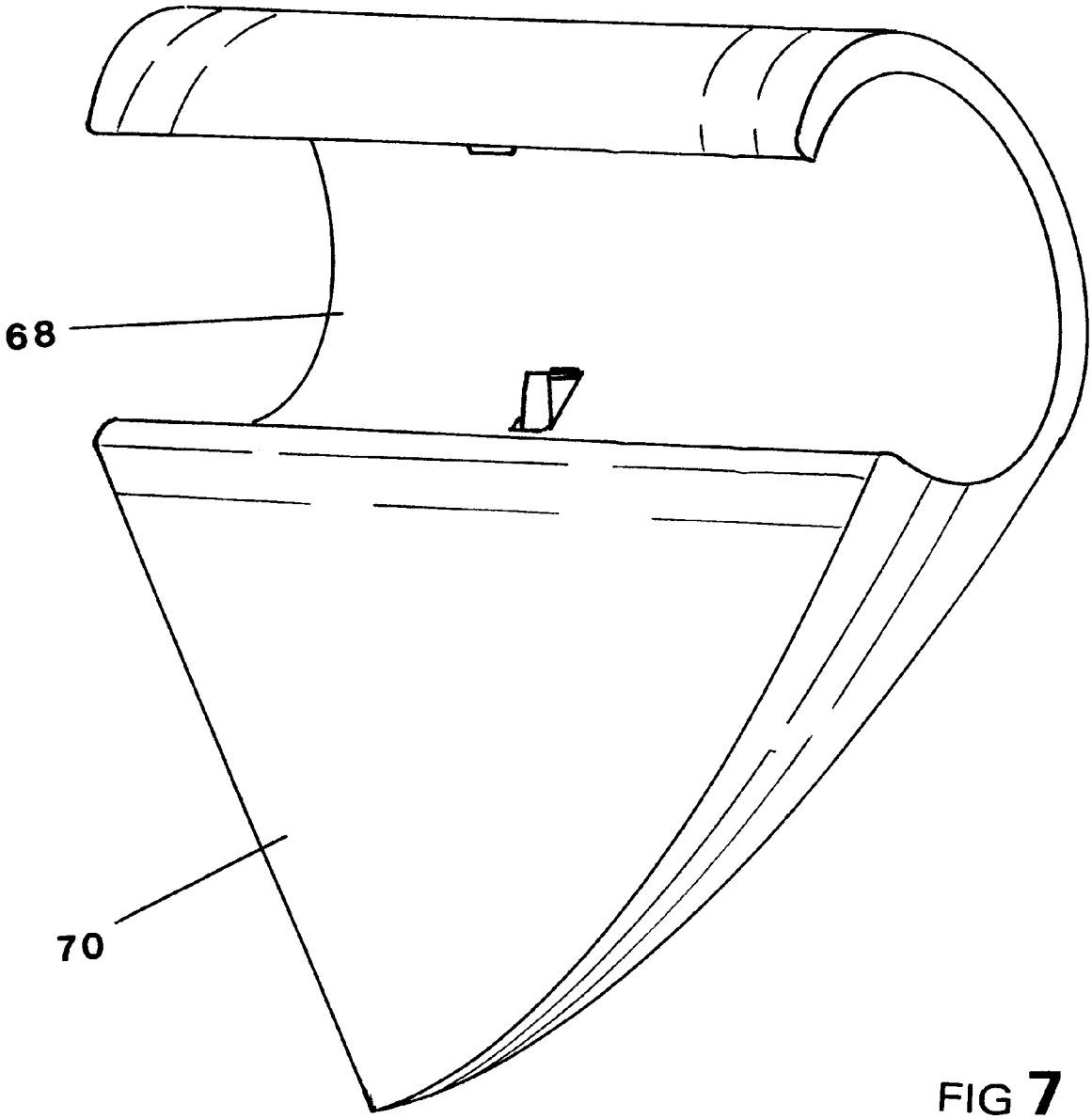
FIG. 7 is a front perspective view of the battery charging device as shown in FIG. 6.

Reffering to FIG. 7, the obverse face of the battery charging means 12 has a laterally extending recess 68 to receive the handle portion 14 of the corkscrew 10, the substantially vertical edge 70 of the charging means 12 being profiled to receive the body portion 16 in nested relation thereagainst.

Use of the corkscrew with an electric cord is contemplated.

What is claimed is:

1. An electrically powered corkscrew having a body portion and a handle extending laterally therefrom, said handle being inclined from said body portion at an included angle in the range 60 to 75 degrees to afford comfortable ergonomic use of the corkscrew, said body portion including an outer barrel to receive the neck of a bottle in entered relation therein; rotatable cork auger means substantially co-extensive and co-axial with said barrel, and cork restraint means located within said barrel in use to limit rotation of a cork relative to said barrel when the cork is penetrated and engaged by said auger.

2. The corkscrew as set forth in claim 1, including bottle stop means within said barrel, to limit the penetration of a bottle neck within the barrel.

3. The corkscrew as set forth in claim 2, said bottle stop means being axially movable a predetermined distance within the said barrel.

4. The corkscrew as set forth in claim 1, said cork restraint means including at least on axially extending rib to engage an outer surface portion of said cork, to substantially preclude rotation of said cork within said barrel.

5. The corkscrew as set forth in claim 4, said cork restraint means including an inner barrel located within said outer barrel and movable axially therein, said cork restraint means including a tongue and groove connection between the inner and the outer barrel, to permit relative axial displacement therebetween while substantially precluding relative rotation thereof.

6. The corkscrew as set forth in claim 5, said cork restraint means including compression spring means extending axially relative to said barrel, in off-centred relation therewith, and connecting with said inner barrel in rotation inhibiting relation.

7. The corkscrew as set forth in claim 6, said off-centred spring means comprising a pair of diametrically spaced compression springs, each having a guide rod extending therethrough, said guide rods projecting within axially extending recesses of said inner barrel, to preclude rotation of said inner barrel.

8. The corkscrew as set forth in claim 4, said cork restraint means including two of said axially extending ribs in mutual, diametrically opposed relation; said ribs being of shallow depth to permit guided displacement of said cork axially therealong.

9. The corkscrew as set forth in claim 3, said bottle stop means comprising an axial, outer end portion of an inner barrel located within said outer barrel and movable axially therein.

10. The corkscrew as set forth in claim 1, wherein the preferred said included angle is about 70 degrees.

11. The corkscrew as set forth in claim 1, including seal cutter means recessed in the butt of said handle, to access the crown of a foil-sealed bottle therein, for cutting the foil seal.

12. The corkscrew as set forth in claim 1, including electric power means located within the said handle.

13. The corkscrew as set forth in claim 12, said electric power means including an electric motor.

14. The corkscrew as set forth in claim 13, including battery means to power said motor.

15. The corkscrew as set forth in claim 12, said battery means comprising rechargeable batteries.

16. The corkscrew as set forth in claim 15, said rechargable batteries being removable from said corkscrew.

17. The corkscrew as set forth in claim 15, in combination with battery charging means.

18. The corkscrew as set forth in claim 17, said battery charging means having a body portion to receive said corkscrew in secured, battery charging relation, and having a pair of electrical spade contacts to suspend the combination in assembled, charging relation from an electrical outlet.

* * * * *